United States Patent [19]

Dooling et al.

[11] Patent Number: 4,727,900

[45] Date of Patent: Mar. 1, 1988

[54] TAMPER-PROOF HYDRANT COVER

[76] Inventors: Joseph S. Dooling, 507 N. Wood River Ave., Wood River, Ill. 62095; Kenneth F. Vanek, 114 Glenwood Dr., Glen Carbon, Ill. 62034; Gene R. Vanek, 86 Crestview Dr., Glen Carbon, Ill. 62034

[21] Appl. No.: 940,747

[22] Filed: Dec. 11, 1986

[51] Int. Cl.[4] ..... E03B 9/06; F16K 35/06

[52] U.S. Cl. ..... 137/296; 29/267; 81/488; 137/382; 137/800; 220/85 P; 220/284

[58] Field of Search ..... 137/296, 382, 385, 800; 220/284, 285, 286, 85 P; 29/267; 81/488; 251/291

[56] References Cited

U.S. PATENT DOCUMENTS

| | | | |
|---|---|---|---|
| 2,118,233 | 5/1938 | Ruggio | 137/296 |
| 3,453,655 | 7/1969 | Quinones et al. | 137/296 |
| 3,623,498 | 11/1971 | Manahan | 137/296 |
| 3,692,042 | 9/1972 | Dashner | 137/296 |
| 3,709,249 | 1/1973 | Diaz | 137/296 |
| 3,769,683 | 11/1973 | Krekeler | 29/267 |
| 3,914,966 | 10/1975 | Bello | 137/296 |
| 4,033,372 | 7/1977 | Bowman | 137/296 |
| 4,369,807 | 1/1983 | Camp | 137/296 |
| 4,484,595 | 11/1984 | Vanek et al. | 220/85 P |
| 4,566,481 | 1/1986 | Leopold, Jr. et al. | 137/296 |

FOREIGN PATENT DOCUMENTS

| | | | |
|---|---|---|---|
| 659383 | 3/1963 | Canada | 137/296 |
| 683937 | 11/1939 | Fed. Rep. of Germany | 137/296 |
| 714177 | 11/1941 | Fed. Rep. of Germany | 137/296 |
| 811384 | 4/1937 | France | 137/296 |

*Primary Examiner*—George L. Walton

*Attorney, Agent, or Firm*—Senniger, Powers, Leavitt and Roedel

[57] ABSTRACT

A tamper-proof cover for the operating nut of a hydrant. The cover includes a housing adapted to be positioned above the operating nut for covering the operating nut, the housing having an opening, a housing mounting device securable to the hydrant and engagable with the housing for securing the housing to the hydrant, and a locking device for removably securing the housing to the mounting device which includes a pin positionable in the opening in the housing and engagable with a recess defined in the mounting device, a locking member engagable with the pin and the recess in the housing, a frangible shoulder within the recess in the mounting device against which the locking member seats and which must be broken to remove the pin. Other forms of the tamper-proof cover and a tool for removing the cover are also disclosed.

36 Claims, 11 Drawing Figures

TAMPER-PROOF HYDRANT COVER

BACKGROUND OF THE INVENTION

The present invention relates to protective devices for hydrants and, more particularly, to protective covers for the operating nut which activates a fire hydrant for use.

The unauthorized operation of fire hydrants is a common urban problem having possibly severe consequences, such as the waste of large quantities of water and the resulting substantial drop in an area's water pressure. Moreover, such tampering oftentimes results in damage to or loss of the operating nut of a fire hydrant which can make the hydrant inoperative and thus result in substantial property damage in the area due to fire.

There have been many attempts in the prior art to protect the operating nut of a hydrant from damage and prevent unauthorized access thereto. For example, U.S. Pat. No. 4,485,595 discloses a cap which surrounds the nut and contains an operating member which fastens to the operating nut and which together prevent access to the nut without a special tool. U.S. Pat. No. 4,398,556 discloses a similar device in which the entire bonnet of the hydrant is replaced with a special bonnet that prevents access to the operating nut without a special tool. U.S. Pat. Nos. 3,453,665; 3,709,249 and 2,118,233 disclose similar devices.

Damage to the operating nut or jamming of the protective devices of the prior art is a common problem as a result of vandals battering on the devices with sledgehammers or other objects which deliver considerable blows to the devices and either break the devices or prevent their removal.

SUMMARY OF THE INVENTION

The present invention overcomes the above described difficulties and disadvantages associated with prior art devices by providing an improved tamper-proof cover for the operating nut of a hydrant which is sufficiently sturdy to take severe blows and which prevents access to the operating nut of the hydrant by unauthorized persons, and yet allows easy access to the operating nut by authorized persons using a unique tool.

The cover of the present invention can cover the existing bonnet on a fire hydrant of certain existing designs, it can replace the bonnet on other existing designs (e.g., "dry" bonnet which does not seal the water in the hydrant) or it can be attached to the existing bonnet for covering only the operating nut and is therefore very versatile. The cover is so designed that the operating nut is completely enclosed and is not in engagement with the cover. The access opening, provided for inserting of the special tool to remove the cover, is so designed that direct blows cannot be administered to the locking mechanism nor can material be lodged in the opening to jam the locking mechanism.

The foregoing advantages over the prior art devices are provided by a tamper-proof cover for the operating nut of a hydrant, the cover including a housing adapted to be positioned above the operating nut for covering the operating nut, the housing having an opening, mounting means securable to the hydrant and engagable with the housing for securing the housing to the hydrant, and locking means for removably securing the housing to the mounting means which includes a pin positionable in the opening in the housing and engagable with a recess defined in the mounting means, a locking member engagable with the pin and the recess in the mounting means, a frangible shoulder within the recess in the mounting means against which the locking member seats and which must be broken to slidably remove the pin from the recess so that the housing can be removed to provide access to the operating nut.

In another aspect of the present invention a tamper-proof cover for the operating nut of a hydrant is provided, the cover including a housing adapted to be positioned above the operating nut and completely covering the operating nut, housing mounting means securable to the hydrant and covered by and engagable with the housing for securing the housing to the hydrant, the mounting means and the housing each having a plurality of mating flanges which are covered by the housing when mutually engaged and which are radially spaced around the housing and mounting means such that rotation of the housing relative to the mounting ring causes engagement and disengagement of the flanges, and locking means for preventing rotation of the housing relative to the mounting means.

In a further aspect of the present invention a tool is provided in combination with the tamper-proof cover. The tool comprises a block insertable in the extension from the housing and having a cavity therein for receiving the end of the pin extending from the hole in the housing, a pawl mounted in the block for pivotal movement into engagement with a groove in the end of the pin extending into the cavity when the block is inserted in the cavity, means for removing the block from the extension while the pawl engages the pin so as to cause the frangible shoulder to break and release the pin for removal with the block.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
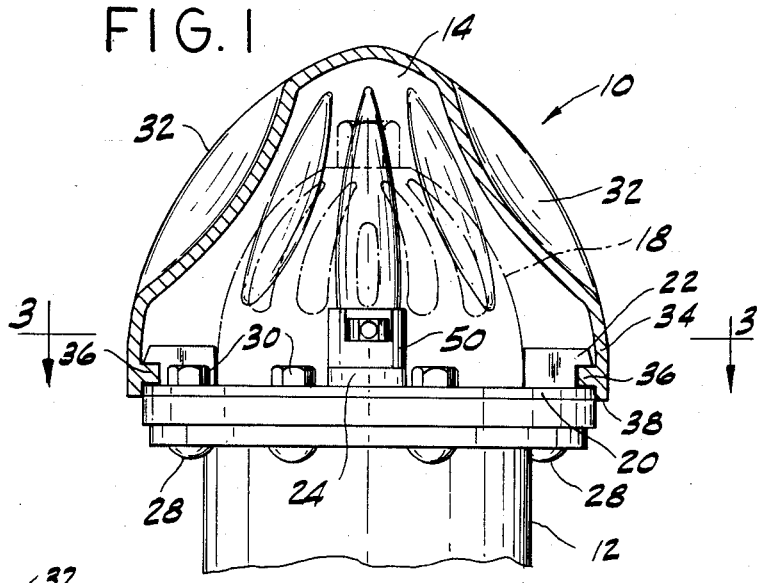
FIG. 1 is an elevational view in partial cross-section of a preferred embodiment of the tamper-proof cover of the present invention mounted to the standpipe of a fire hydrant.

As shown in FIG. 1, the first alternative preferred embodiment of the tamper-proof cover includes a housing 10 which mounts to the standpipe 12 of an existing fire hydrant or fire plug so as to completely and securely cover the operating nut 14 used to turn on and off the water flow from the outlet nozzle 16 of a hydrant. With some hydrant designs, the housing 10 will be put on the hydrant over the top of bonnet 18, as shown in phantom in FIG. 1. In other hydrant designs it is contemplated that the bonnet can be removed and replaced with the housing 10.

In either case of applying the cover to a standpipe 12, either with or without the bonnet, the housing 10 is secured through the use of a housing mounting means in the form of a mounting ring 20. The ring 20 is designed to have the same bolt pattern as the existing bolt pattern on the standpipe 12 so that no alteration or addition is required to the standpipe. The ring 20 has a plurality of upwardly extending projections forming locking lugs which, in the first preferred embodiment, consists of four arcuate flanges 22 extending from support blocks 24 equally spaced around the periphery of the ring 20. The bolts 26 which secure the ring 20 to the standpipe 12 are similar to case hardened carriage bolts with a smooth head 28 which prevents removal of the bolts from the standpipe when the housing 10 is in place since the nuts 30 must be loosened to remove the bolts and this can only be done With the housing 10 removed.

The housing 10 is generally dome-shaped as shown in FIG. 1, and has a plurality of indentations 32 which are intended to give it the appearance of a standard bonnet of a fire hydrant so as to cause less attention to its presence. The housing 10 has a circular base portion 34 which has an outer diameter substantially the same as the outer diameter of the ring 20. A series of arcuate locking flanges 36 are formed on the inside surface of the housing 10 at locations corresponding to the flanges 22 on ring 20 and are formed for mating therewith. The lower edge 38 of the housing 10 preferably extends over the ring 20 to prevent possible insertion of a prybar under the cap to attempt its removal.

The housing 10 is also provided with an extension 40 which protrudes from a side of the housing 10 and protects an opening 42 in the housing whose function is described later. The extension 40 is formed with an inverted generally U-shaped cavity 44 opening downwardly from its outer end 46 to the surface 48 of the housing 10 adjacent the opening 42 therein and has outer side surfaces 50*a* and 52*a* which are tapered towards one another and a top surface 54*a* of the extension is tapered downwardly from the adjacent outer surface 48 of the housing. The purpose of the tapered surfaces of the extension 40 are to prevent the application of a blow by a hammer or the like directly on the extension 40 so as to shear it off from the housing 10. The tapered surfaces insure that any such blow from the top or sides would be a glancing blow which would greatly reduce the stress on the material that would otherwise be felt.

Figure 6:
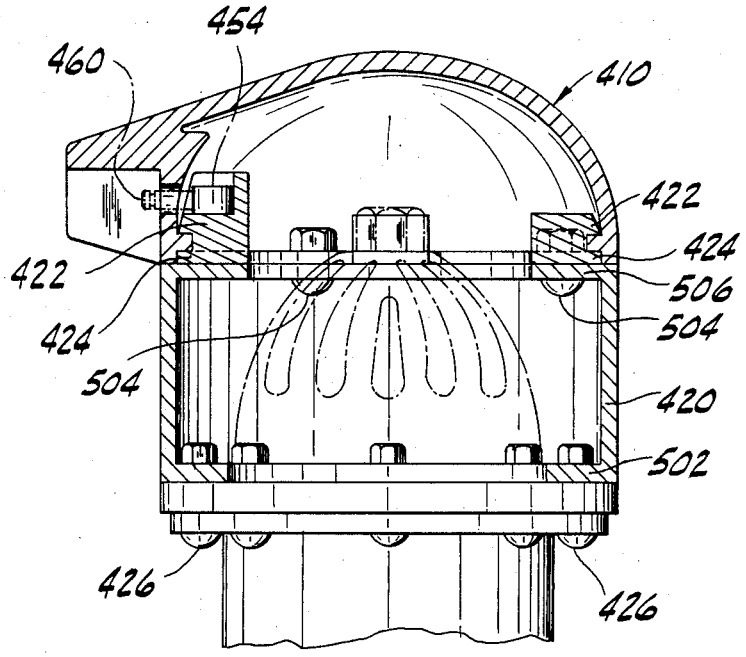
FIG. 6 is an elevational view in partial cross-section of a third, alternative, preferred embodiment of the present invention mounted to the stand pipe of a fire hydrant.

One of the support blocks 24 is larger than the others and forms a locking block 50. Locking block 50 has a rectangular opening 52 defined therein (see FIGS. 9–11) for receiving a cylindrical locking member 54. Locking member 54 sets on the shelf 56 formed in the rectangular opening 52 and can be slid into the rectangular opening from the open side as shown in FIG. 6, but without the housing 10 in place. Cylindrical locking member 54 has a contoured blind hole 55 formed therein for receiving one end of a locking pin 60 and a lock ring 62. A groove 64 is formed in the hole 55 to receive the ring 62. Ring 62 is an open expansion ring made of hard steel and which can be contracted to insert it in the groove 64.

Figure 8:
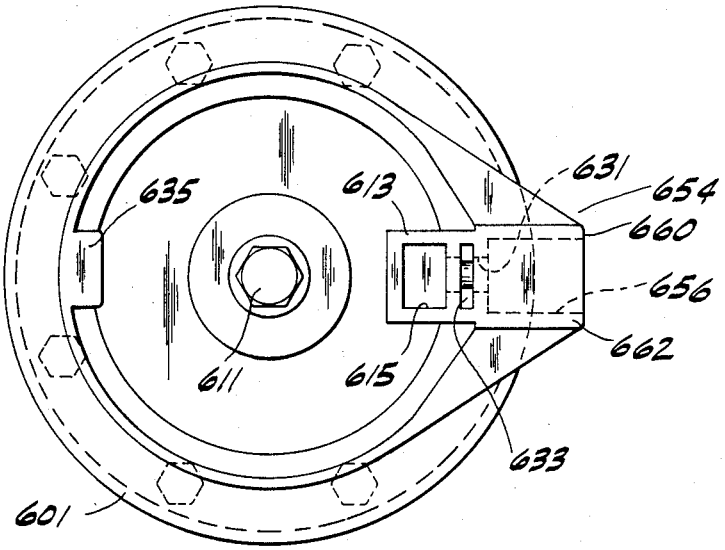
FIG. 8 is a cross-sectional view in the direction of line 8—8 of FIG. 7 with a housing included in the present invention removed.

With the ring 62 in the groove 64 the pin 60 can be inserted in the hole 55 up to the shoulder 66 on the pin 60 with the ring 62 fitting in the groove 68. The spacing and the dimensions of the groove 64, ring 62 and groove 68 are such that the pin 60 can be inserted in the hole 55 with the ring 62 in place and thereafter cannot be removed without destruction of a portion of the edge 70 of the groove 64, as shown in FIG. 8.

Figure 4:
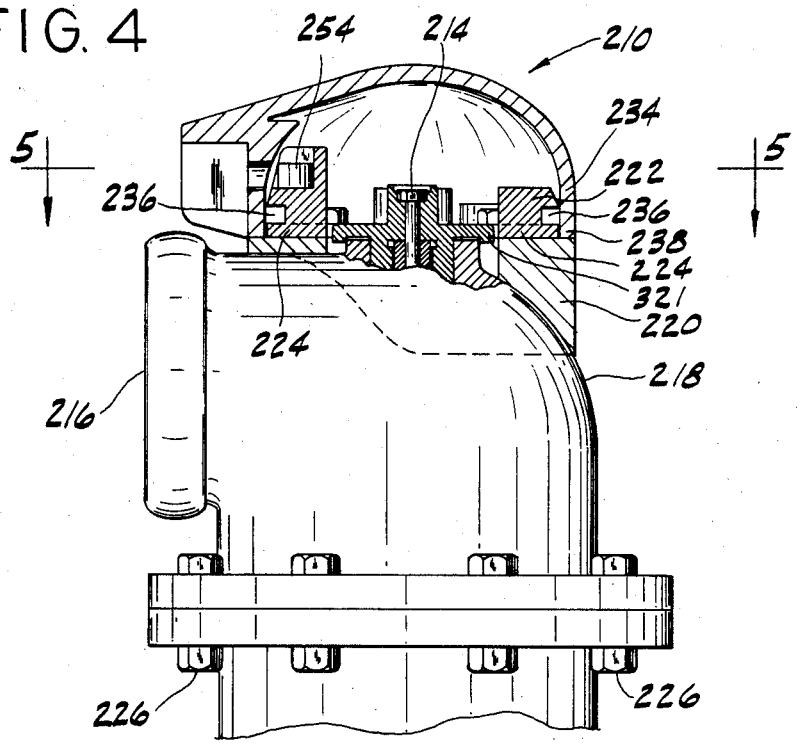
FIG. 4. is an elevational view in partial cross-section of a second, alternative, preferred embodiment of the present invention mounted to the bonnet of a fire hydrant.
Figure 5:
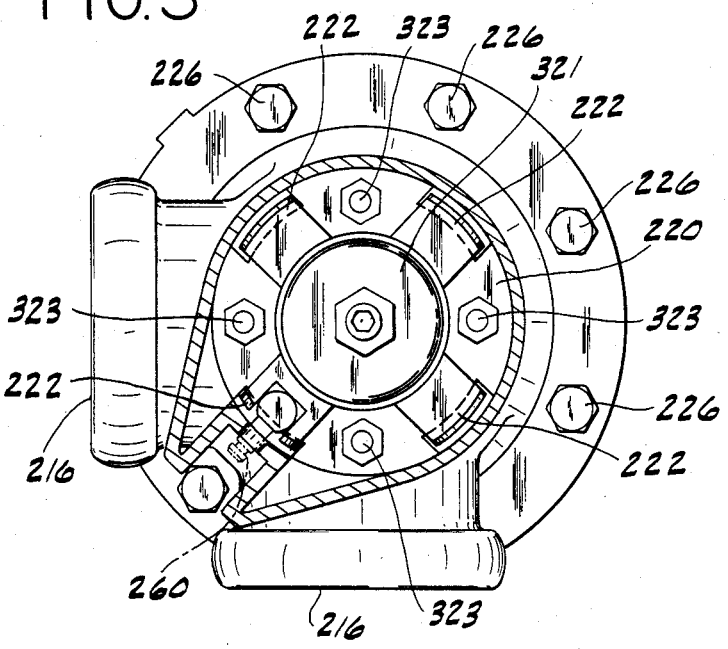
FIG. 5 is a cross-sectional view in the direction of line 5—5 of FIG. 4.

As shown in FIG. 4, the second, alternative, preferred embodiment of the tamper-proof cover includes a housing 210 which mounts to a bonnet 218 of an existing fire hydrant or fire plug so as to completely and securely cover the operating nut 214 used to turn on and off the water flow from the outlet nozzles 216 of a hydrant. The hydrant shown in FIGS. 4 and 5 is of a different design from that shown in connection with the first embodiment and the cover of the present invention may be easily adapted for use therewith.

As will be noted, this second, alternative, preferred embodiment is substantially similar to the first preferred embodiment previously described and thus the discussion has been abbreviated to avoid excessive repetition. FIGS. 4 and 5 correspond, respectively, to FIGS. 1 and 2. For convenience the number designations in FIGS. 4 and 5 have had the number 200 added to those corresponding designations in FIGS. 1 and 2. Those designations in FIGS. 4 and 5 with no corresponding designation in FIGS. 1 and 2 begin with the 300 designation.

In the second, alternative, preferred embodiment the housing 210 is of reduced size compared to housing 10 and is generally dome-shaped as shown in FIG. 4, but does not have the plurality of indentations as in the first preferred embodiment. The housing 210 is secured through the use of a mounting means in the form of a mounting ring 220. The ring 220 is designed to fit around a flanged portion 321 of the bonnet 218 and rest on the contour of the bonnet 218 with no addition required to the bonnet. Bolts 323 pass through the ring 220 into the bonnet 218 for securing the ring. The bolts 323 thus cannot be removed since they are completely enclosed by the housing 210 and bonnet 218. The bolts 226 (similar to bolts 26) thus are not used for securing the ring 220. The ring 220 has a plurality of upwardly extending projections forming locking lugs which consist of four arcuate flanges 222 extending from support blocks 224 equally spaced around the periphery of the ring 220. A locking pin 260 is inserted into a hole (not shown) to secure the housing 210 to the hydrant.

As will also be readily appreciated, the housing 210 may be adapted to fit around the operating nut 14 of the hydrant shown in FIG. 1. This second alternative preferred embodiment may thus be readily adapted for use on hydrants of the type shown in either FIG. 1 or FIG. 4.

Figure 2:
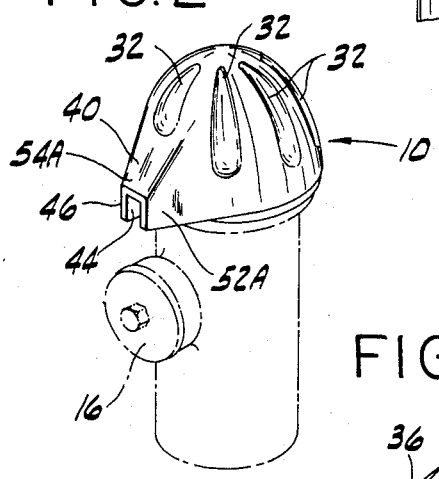
FIG. 2 is a pictorial view of the embodiment of FIG. 1 with the fire hydrant shown in phantom.
Figure 3:
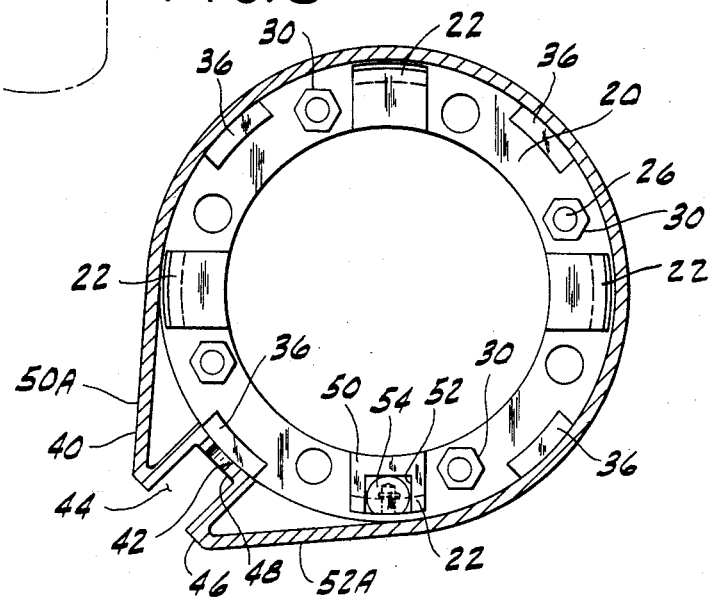
FIG. 3 is a cross-sectional view in the direction of line 3—3 of FIG. 1.

The remaining parts shown in FIGS. 4 and 5 are functionally similar to those shown in FIGS. 1–3 and will for brevity not be described further.

In FIG. 6 a third, alternative, preferred embodiment is shown attached to the standpipe of the hydrant. Since this third alternative embodiment is similar to the first two, the number designations in FIG. 6 have had the number 400 added to those corresponding designations in FIGS. 1 and 2. Those designations in FIG. 6 with no corresponding designation in FIGS. 1 and 2 begin with the 500 designation.

The housing 410 is substantially similar in shape to the housing 210. Housing 410 is secured to the hydrant by a ring shaped mounting device 420 designed to attach at a flanged end 502 to the standpipe by bolts 426. Bolts 504, substantially similar to bolts 323 in FIG. 5, secure flanges 422 to an upper lip 506. The flanges 422 extend from support blocks 424 equally spaced around the lip 506 to form a locking lug. A pin 460 is inserted into hole 455 (not shown) to secure the housing 410 such that it will not rotate.

The remaining parts of this embodiment as shown in FIG. 6 are functionally similar to those of the embodiment shown in FIGS. 1–3 and will for brevity not be described further.

Figure 7:
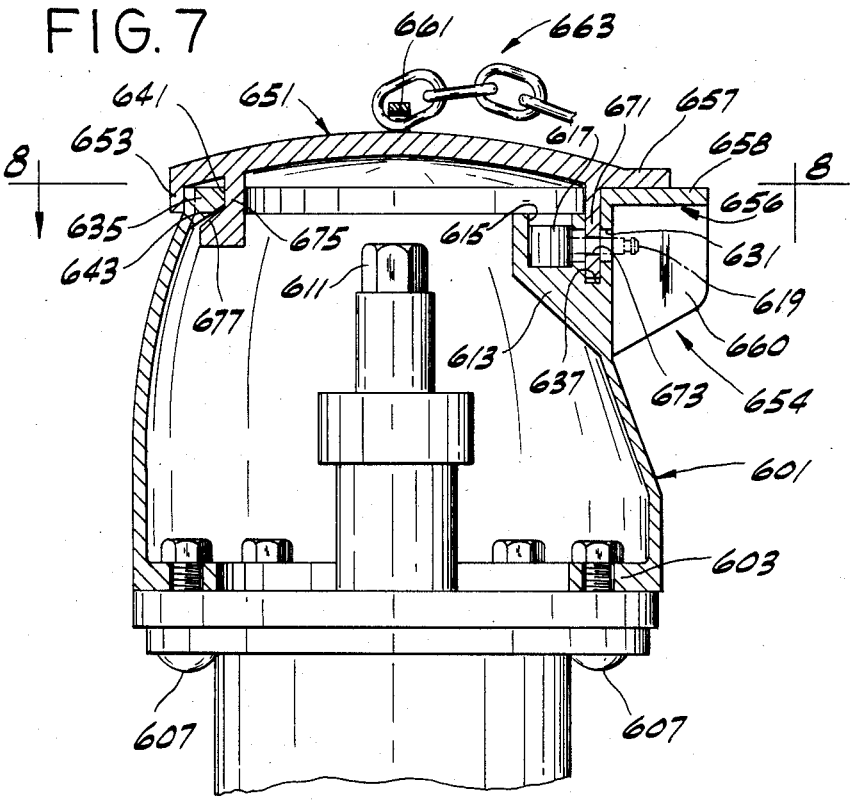
FIG. 7 is an elevational view in partial cross-section of a fourth, alternative, preferred embodiment of the present invention shown replacing the "dry" bonnet of a hydrant.

The fourth alternative embodiment includes a substantially cyclindrically shaped mounting device 601 having a flanged end 603 attached to the standpipe by bolts 607. As shown in FIGS. 7 and 8, the mounting device 601 replaces the "dry" bonnet of the hydrant and provides a surrounding outer wall to protect the operating nut 611. As will be easily appreciated, this fourth alternative embodiment may be modified for use with the bonnet of the hydrant in place. Mounting device 601 has an inwardly extending U-shaped holder 613 with a slot or opening 615 for sliding a locking member 617 from the open side (similar to locking member 54 of the first, alternative, preferred embodiment). Locking member 617 includes a contoured blind hole formed therein (not shown) for receiving one end of a locking pin 619 (similar to pin 60), and a lock ring (not shown) similar to the lock ring 62.

Mounting device 601 has an opening or recess 631 which is sized and shaped to fit the pin 619. A slot 633 and a ledge 635 are diametrically opposite and their use will be later described. Slot 633 is rectangularly shaped and extends from the top of device 601 to a groove 637 in holder 613. Ledge 635 has a vertical portion 641 and a tapered portion 643.

The mounting device 601 also includes an extension 654 forming a U-shaped cavity 656 which opens downwardly. A flat outer end 658 and side portions 660 and 662 of the extension 654 are positioned around the recess 631 for protection from direct blows as from a hammer or the like.

A lid or housing 651 is adapted to fit on to the housing device 601. The housing 651 is substantially disk-shaped and includes a edge bead 653 around the circumference to seal it to housing device 601. The housing 651 has a tongue shaped portion 657 for placement above the flat outer end 658 of the extension 654. The housing 651 also has an eye 661 attached thereto for securing one end of a chain 663. Another end of chain 663 (not shown) is attached to the hydrant and may, for example, be adapted to be secured to one of the bolts 607 thereby preventing the separation and loss of housing 651.

Housing 651 also includes a rectangularly shaped tab 671 adjacent the tongue 657 adapted for insertion in slot 633. Tab 671 has an opening or recess 673 through which pin 619 is inserted. A vertical member 675, diametrically opposite tab 671, is also included with housing 601 and has a tapered portion 677 adapted to fit adjacent tapered portion 643 of housing 601.

Figure 9:
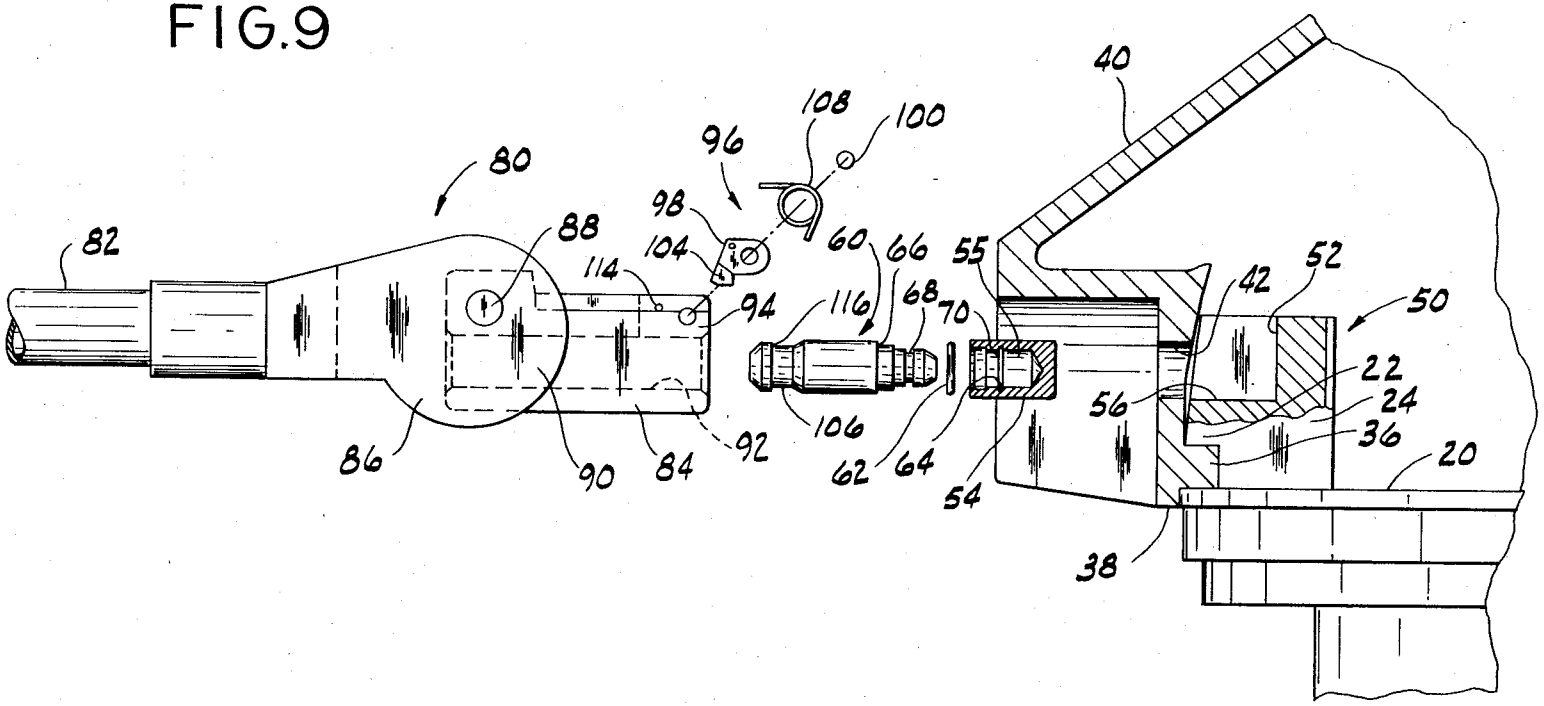
FIG. 9 is an enlarged exploded view of a portion of the embodiment of the cover of FIG. 1 in cross-section and a tool for inserting the pin in the opening of the cover and the receiving recess of the locking means.
Figure 10:
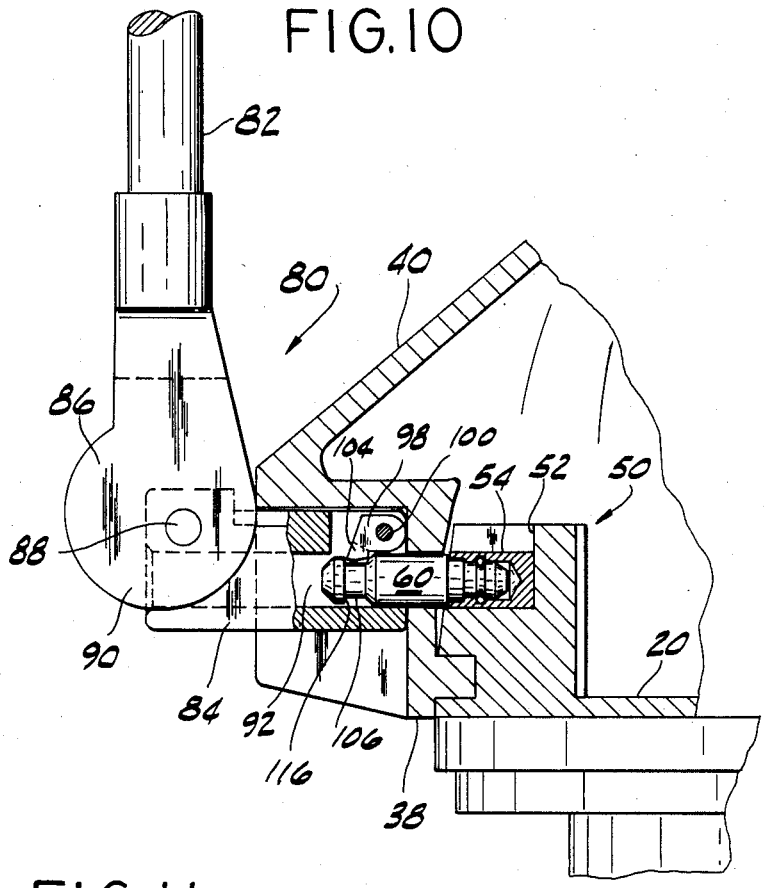
FIG. 10 is a partial enlarged view of the cover of FIG. 1 showing the tool of FIG. 9 inserting the pin in the receiving recess of the locking means.
Figure 11:
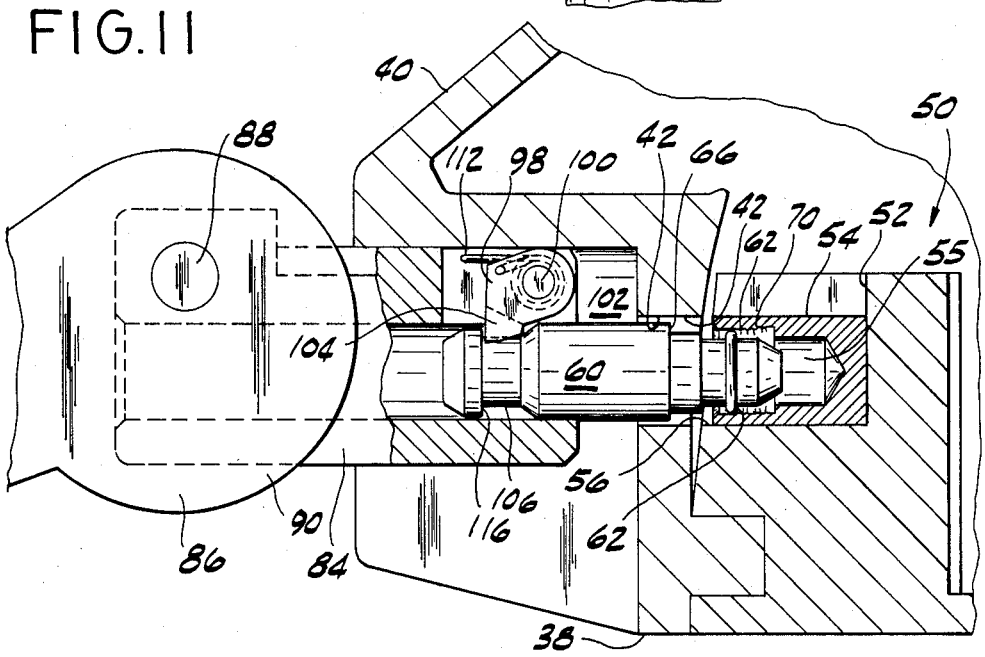
FIG. 11 is a view similar to FIG. 10 showing the pin being removed by the tool and the destruction of the shoulder on the receiving recess in the locking means due to the pin being withdrawn.

A tool 80 for removing the pin 60 of the first preferred embodiment, pin 260 of the second preferred embodiment, pin 460 of the third preferred embodiment or pin 619 of the fourth preferred embodiment, is shown in FIGS. 9–11. The tool 80 may be used to remove pins from any of the embodiments by constructing such pins of the same dimensions and a single tool 80 may thus used for access to the operating nut. The alternative preferred embodiments have parts which are functionally similar to those in the first preferred embodiment and therefore for brevity the first preferred embodiment will only be described.

The tool 80 is connected to a handle 82 of sufficient length to provide adequate leverage to withdraw the pin 60 by upsetting the lip 70 in the locking member 54. For convenience, tool 80 may be attached to a wrench normally used for the operating nut. The tool 80 includes a generally rectangular cross-section metal bar 84 which is pivotally connected to a head 86 by a pin 88 which is mounted eccentrically in the head to provide a camming action as described below. The head 86 is formed with two tabs 90 (only one shown) which receive the bar 84 between them. Each of the tabs 80 has a rounded outer end beyond which the bar 84 extends and pivots between.

Bar 84 has a cylindrical hole 92 extending therethrough of a diameter slightly larger than the pin 60 for receiving the pin 60 therein. In the upper outer end portion 94 of the bar 84 is mounted a toggeling mechanism 96 which includes a latching member 98 pivotally mounted by a pin 100 between a pair of ears 102 ( only one is shown) in a recess formed in the end portion 94 of the bar 84. The latching member 98 has an extension 104 which matingly engages a groove 106 in the pin 60 when it is inserted in the hole 92. A coil spring 108 fits around the pin 100 within the recess formed in the end portion 94 and has one leg which fits over the extension 104 and another leg 112 which fits in a hole 114 in the side of the portion 94 of the bar 84 so as to bias the latching member 98 into the position shown in FIG. 11, but allows the latching member to be swung out of the way for insertion of the pin 60 into the hole 92. Once the pin 60 is inserted into the hole 92 the latching member then moves back into the groove 106 and engages the lip 116 formed thereby to prevent the removal of the pin from the hole 92 and transmit the force from the tool 80 to the pin 60 in order to remove it.

In the operation of the first, alternative, preferred embodiment, the mounting ring 20 is secured to the standpipe 12 of a fire hydrant. The locking member 54 is then inserted in the recess 52 with the hole 55 directed outwardly. The housing 10 is then placed on the mounting ring with the locking flanges 36 on the housing out of alignment with the locking lugs 22 on the mounting ring 20, as shown in FIG. 3. The housing 10 is then rotated to align the locking lugs 22 and flanges 36, with the hole 42 in the housing in alignment with the hole 55 in the locking member 54. The ring 62 is then fitted on the pin 60 and they are inserted into the hole 55 until the ring is in the groove 64. The housing 10 is then securely locked on the standpipe 12 and cannot be removed except by use of the tool 80.

The operation of the second, alternative, preferred embodiment is very similar to that of the first preferred embodiment except that the mounting ring 220 is secured to the bonnet 218 of a fire hydrant. The housing 210 is secured to the hydrant, as shown in FIG. 5, in a similar manner to the first preferred embodiment and cannot be removed except by use of the tool 80.

Operation of the third alternative embodiment is also very similar to that of the first preferred embodiment except that ring flanges 422 are positioned at approximately the level of the operating nut and are attached to a ring shaped mounting device 420. The device 420 is secured to the hydrant by bolts 426 which are tightened by inserting a wrench in the space between the lip 506 and the bonnet of the hydrant. As shown in FIG. 6, housing 410 is secured to the hydrant in a similar manner to the first preferred embodiment and is not removable except using tool 80.

The fourth, alternative, preferred embodiment operates in a slightly modified manner. As shown in FIG. 8, the mounting device 601 is first attached by bolts 607 to the standpipe of the hydrant. As will be easily appreciated, the bonnet may be replaced by the device 601 or the bonnet may be secured back in place by the bolts 607. Locking member 617 is then slid into the holder 613. The housing or lid 651 is installed over the mounting device 601 by first inserting the tapered portion 677 of the housing 651 next to the tapered portion 643 of the mounting device 601. Such insertion is done by tilting the tongue 657 upward and fitting corner 653 atop the mounting device 601 and lowering the tongue 657.

The tongue 657 is lowered such that the tab 671 is inserted into the slot 633. When tongue 657 rests on end 658, pin 619 is inserted into the opening or recess 631, through opening or recess 673 in the tab and into the contoured blind hole (not shown) in locking member 617. Pin 619 is thus locked in the locking member 617 and lid 651 cannot be removed unless pin 619 is extracted by using the tool 80.

To remove the pin 60 in the first preferred embodiment from the hole 55 with the ring 62 in place, the bar 84 is slid over the protruding end of the pin 60 which fits in the hole 92 until the rounded end of the tool engages the outer surface of the housing 10. At this point, the extension on the latching member engages the shelf 116 formed by the groove 106 beginning with the handle 82 and tool 80 in the position shown in FIG. 7, the handle is rotated in the counter-clockwise direction to the position shown in FIG. 8. This causes the tool to apply adequate force to upset the lip 70 in locking member 54 and thus allow the pin and ring 62 to be removed. The housing 10 can then be freely rotated on the mounting ring 20 sufficiently to disengage the locking lugs and allow the housing to be removed to permit access to the operating nut 141.

The removal of the pin 260 in the second, alternative, preferred embodiment is similar to the removal in the first preferred embodiment. The tool 80 applies adequate force to allow the pin 260 and ring 262 to be removed. The housing 210 can then be freely rotated on the mounting ring 220 sufficiently to disengage the locking lugs and allow the housing to be removed to permit access to the operating nut 214.

Pin 460 in the third, alternative, preferred embodiment is removed in a similar manner to that of pin 60 in the first alternative embodiment. Tool 80 applies force to remove pin 460 and the housing 410 is then easily rotated to disengage 17 from the locking lug and permit access to the operating nut.

In the fourth, alternative, preferred embodiment the pin 619 is removed in a similar manner to that of pin 60. Tool 80 applies force to remove the pin 619 and the housing 651 may then be lifted. Tongue 657 is tilted upward by lifting at the tongue or by pulling chain 663. When housing 651 is tilted enough, the sloped portion 677 of vertical member 675 is lifted and pulled toward the tongue side of housing 651. The corner 653 is thus disengaged from the mounting 601, the housing 651 removed, and the operating nut 611 is made accessible for operation.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A tamper-proof cover for the operating nut of a hydrant, the cover comprising:

a housing adapted to be positioned above the operating nut for covering the operating nut, the housing having an opening;

mounting means securable to the hydrant and engagable with the housing for securing the housing to the hydrant; and locking means for removably securing the housing to the mounting means including a pin positionable in the opening in the housing and engagable with a recess defined in the mounting means, a locking member engageable with the pin and the recess in the mounting means, a frangible shoulder within the recess in the mounting means against which the locking member seats and which must be broken to slidably remove the pin from the recess so that the housing can be removed to provide access to the operating nut.

2. The cover of claim 1 wherein:

the hydrant includes a standpipe above which the operating nut extends and said mounting means is adapted for securable engagement with the standpipe.

3. The cover of claim 1 wherein:

the hydrant includes a bonnet above which the operating nut extends and said mounting means is adapted for securable engagement with the bonnet.

4. The cover of claim 1 wherein:

the mounting means includes a ring-shaped member having a plurality of holes corresponding to bolt positions in the hydrant and a plurality of arcuate flanges spaced around the ring; and the housing is dome-shaped for covering the mounting means and has a circular base portion with an external diameter approximately that of the outer diameter of the ring, and has a plurality of arcuate flanges on its inner surface corresponding to the flanges on the ring and matingly shaped so that rotation of the housing relative to the ring causes the flanges to engage or disengage so as to secure or unsecure the housing to the ring.

5. A cover as defined in claim 4 wherein:

the pin is cylindrical and has a groove around its circumference;

the mounting means includes a pin retaining member pivotally mounted to the ring in alignment with the opening in the housing, the pin retaining member containing the recess and the frangible shoulder, the recess being in the form of a cylindrical hole of slightly larger diameter than the pin and the shoulder being an annular shoulder in a groove within the recess of slightly larger diameter than the recess; and the locking member is an expandable ring positionable in the groove and insertable in the hole with the pin so as to expand in the groove in the recess and prevent withdrawal of the pin by engaging the shoulder in the groove in the recess.

6. A cover as defined in claim 5 wherein:

the housing includes an extension around the opening; and an end of the pin, remote from the recess in the mounting means when the pin is positioned in the recess, extending into the extension and having a further groove therein for receiving a portion of a tool positionable in the extension for use in extracting the pin from the mounting means and housing.

7. A cover as defined in claim 6 wherein the extension is formed with an inverted generally U-shaped cavity opening downwardly from its outer end to the surface of the housing adjacent the hole therein, and outer side surfaces of the extension are tapered towards one another and the top surface tapered downwardly from the adjacent surfaces of the housing.

8. The cover of claim 1 wherein the housing is disk shaped and includes a downwardly extending tab having the opening therein; and the mounting means is generally cylindrically shaped having an inwardly extending lip around the top circumference for supporting the disk shaped housing thereon.

9. The cover of claim 8 wherein the housing includes another downwardly extending tab having a sloped shoulder and the mounting means includes another recess for receiving the other tab, the other recess having an edge for engaging the shoulder thereby holding the housing to the mounting means.

10. A cover as defined in claim 9 wherein:

the pin is cylindrical and has a groove around its circumference;

the mounting means includes an inwardly extending holder and a pin retaining member in the holder in alignment with the opening in the housing, the pin retaining member containing the recess and the frangible shoulder, the recess being in the form of a cylindrical hole of slightly larger diameter than the pin and the shoulder being an annular shoulder in a groove within the recess of slightly larger diameter than the recess; and the locking member is an expandable ring positionable in the groove and insertable in the hole with the pin so as to expand in the groove in the recess and prevent withdrawal of the pin by engaging the shoulder in the groove in the recess.

11. A cover as defined in claim 10 wherein:

the mounting means includes an extension around the recess; and an end of the pin, remote from the recess in the mounting means when the pin is positioned in the recess, extending into the extension and having a further groove therein for receiving a portion of a tool positionable in the extension for use in extracting the pin from the mounting means and housing.

12. A cover as defined in claim 11 wherein the extension is formed with a generally U-shaped cavity opening downwardly from its outer end to the surface of the mounting means adjacent the hole therein, and outer side surfaces of the extension are tapered towards one another.

13. A tool in combination with the tamper-proof cover defined in claim 1, the tool comprising:

a block insertable in the housing and having a cavity therein for receiving the end of the pin extending from the opening in the housing;

a pawl mounted in the block for pivotal movement into engagement with a groove in the end of the pin extending into the cavity when the block is inserted in the cavity;

means for removing the block from the extension while the pawl engages the pin so as to cause the frangible shoulder to break and release the pin for removal with the block.

14. A tamper-proof cover for the operating nut of a hydrant, the cover comprising:

a housing adapted to be positioned above the operating nut and completely covering the operating nut;

housing mounted means securable to the hydrant and covered by and engagable with the housing for securing the housing to the hydrant;

the mounting means and the housing each having a plurality of mating flanges which are covered by the housing when mutually engaged and which are radially spaced around the housing and mounting means such that rotation of the housing relative to the mounting ring causes engagement and disengagement of the flanges; and locking means for preventing rotation of the housing relative to the mounting means, the locking means including a pin engageable with the housing and a recess defined in the mounting means, a locking member engageable with the pin and the recess in the mounting means, frangible means in the locking member for securing the pin to the locking member, the frangible means being breakable to remove the pin from the recess so that the housing can be removed to provide access to the operating nut.

15. The cover of claim 14 wherein:

the hydrant includes a standpipe above which the operating nut extends and said housing mounting means is adapted for securable enagagement with the standpipe.

16. The cover of claim 14 wherein:

the hydrant includes a bonnet above which the operating nut extends and said housing mounting means is adapted for securable enagagement with the bonnet.

17. The cover of claim 14 wherein:

the mounting means includes a ring-shaped member having a plurality of holes corresponding to bolt positions in the hydrant and the plurality of flanges thereon are arcuate and spaced around the ring; and the housing is dome-shaped with a circular base portion with an external diameter approximately that of the outer diameter of the ring, and has a plurality of arcuate flanges on its inner surface corresponding to the flanges on the ring and matingly shaped so that rotation of the housing relative to the ring causes the flanges to engage or disengage so as to secure or unsecure the housing to the ring.

18. A tamper-proof cover for the operating nut of a hydrant, the cover comprising:

a housing adapted to be position above the operating nut and completely covering the operating nut;

housing mounting means securable to the hydrant and covered by and engageable the housing for securing the housing to the hydrant;

the mounting means and the housing each having a plurality of mating flanges which are covered by the housing when mutually engaged and which are radially spaced around the housing and mounting means such that rotation of the housing relative to the mounting ring causes engagement and disengagement of the flanges;

locking means for preventing rotation of the housing relative to the mounting means;

the mounting means including a ring-shaped member having a plurality of holes corresponding to bolt positions in the hydrant and the plurality of flanges thereon are arcuate and spaced around the ring;

the housing is dome-shaped with a circular base portion with an external diameter approximately that of the outer diameter of the ring, and has a plurality of arcuate flanges on its inner surface corresponding to the flanges on the ring and matingly shaped so that rotation of the housing relative to the ring causes the flanges to engage or disengage so as to secure or unsecure the housing to the ring;

the housing including an opening in a side portion thereof; and the locking means including a pin positionable in the opening in the housing and engageable with a recess defined in the mounting means, a locking member engageable with the pin and a recess in the mounting means, a frangible shoulder within the recess in the mounting means against which the locking member seats and which must be broken to slidably remove the pin from the recess so that the housing can be removed to provide access to the operating nut.

19. A cover as defined in claim 18, including:

the housing includes an extension around the opening; and an end of the pin, remote from the recess in the mounting means when the pin is positioned in the recess, extending into the extension and having a further groove therein for receiving a portion of a tool positionable in the extension for use in extracting the pin from the mounting means and housing.

20. A cover as defined in claim 19 wherein the extension is formed with an inverted generally U-shaped cavity opening downwardly from its outer end to the surface of the housing adjacent the hole therein, and outer side surfaces of the extension are tapered towards one another and the top surface tapered downwardly from the adjacent surfaces of the housing.

21. A tamper-proof cover for the operating nut of a hydrant, the cover comprising:

a housing adapted to be positioned above the operating nut for covering the operating nut;

mounting means securable to the hydrant and engageable with the housing for securing the housing to the hydrant;

the mounting means having a passageway and the housing having a tab for engagement in the passageway; and locking means for securing the tab in the passageway to prevent removal of the housing from the mounting means, the locking means including a pin engageable with the tab and a recess defined in the mounting means, a locking member engageable with the pin and the recess in the mounting means, frangible means in the locking member for securing the pin to the locking member, the frangible means being breakable to remove the pin from the recess so that the housing can be removed to provide access to the operating nut.

22. The cover of claim 21 wherein:

the hydrant includes a standpipe above which the operating nut extends and said mounting means is adapted for securable enagagement with the standpipe.

23. The cover of claim 21 wherein:

the mounting means includes a ring-shaped ledge having a plurality of holes corresponding to bolt positions in the hydrant and an inwardly extending lip at an end of the mounting means opposite the ledge; and the housing is disk-shaped with external dimensions slightly greater than that of the lip.

24. A tamper-proof cover for the operating nut of a hydrant, the cover comprising:

a housing adapted to be positioned above the operating nut for covering the operating nut;

mounting means securable to the hydrant and engageable with the housing for securing the housing to the hydrant;

the mounting means having a passageway and the housing having a tab for engagement in the passageway; and locking means for securing the tab in the passageway to prevent removal of the housing from the mounting means;

the mounting means including a ring-shaped ledge having a plurality of holes corresponding to bolt positions in the hydrant and an inwardly extending lip at an end of the mounting means opposite the ledge;

the housing is disk-shaped with external dimensions slightly greater than that of the lip;

the mounting means including an opening in a side portion thereof; and in a side portion thereof; and the locking means including a pin positionable in the opening in the mounting means and engageable with a recess defined in the tab, a locking member engageable with the pin and a recess in the mounting means, a frangible shoulder within the recess in the tab against which the locking member seats and which must be broken to slidably remove the pin from the recess so that the housing can be removed to provide access to the operating nut.

25. A cover as defined in claim 24, including:

the mounting means includes an extension around the opening; and an end of the pin, remote from the recess in the tab when the pin is positioned in the recess, extending into the extension and having a further groove therein for receiving a portion of a tool positionable in the extension for use in extracting the pin from the mounting means and housing.

26. A tamper-proof cover for the operating nut of a hydrant, the cover comprising:

a domed-shaped housing adapted to be positioned above the operating nut and completely covering the operating nut, an extension on a side portion of the housing and a circular hole in the housing within the extension;

a housing mounting ring securable to the hydrant, the ring having means providing a cylindrical recess therein positionable in alignment with the opening in the housing;

the ring and the housing each having a plurality of mating flanges which are covered by the housing when mutually engaged and which are radially spaced around the housing and ring such that rotation of the housing relative to the mounting ring causes engagement and disengagement of the flanges; and locking means for preventing rotation of the housing relative to the ring, including a cylindrical pin positionable in the hole in the housing and matingly engageable with the cylindrical recess when the recess and a hole are aligned, the means providing the recess having a frangible shoulder within the recess spaced from but adjacent the pin, the pin having a groove therein adjacent the shoulder and a ring fitted in the groove and engaging the shoulder when the pin with the ring is inserted in the recess whereby the pin cannot be removed without the ring breaking the shoulder, the pin being slidably removable from the recess upon breaking the shoulder so that the housing can be removed to provide access to the operating nut.

27. The cover of claim 26 wherein:

the hydrant includes a standpipe above which the operating nut extends and said housing mounting ring is adapted for securable engagement with the standpipe.

28. The cover of claim 26 wherein:

the hydrant includes a bonnet above which the operating nut extends and said housing mounting ring is adapted for securable engagement with the bonnet.

29. A cover as defined in claim 26 wherein the extension is formed with an inverted generally U-shaped cavity opening downwardly from its outer end to the surface of the housing adjacent the hole therein, and outer side surfaces of the extension are tapered towards one another and the top surface tapered downwardly from the adjacent surfaces of the housing.

30. A tool in combination with the tamper-proof cover defined in claim 26, the tool comprising:

a block insertable in the extension from the housing and having a cavity therein for receiving the end of the pin extending from the hole in the housing;

a pawl mounted in the block for pivotal movement into engagement with a groove in the end of the pin extending into the cavity when the block is inserted in the cavity;

means for removing the block from the extension while the pawl engages the pin so as to cause the frangible shoulder to break and release the pin for removal with the block.

31. A tool in combination with the tamper-proof cover defined in claim 30, wherein the means for removing the tool includes:

a camming member pivotally mounted to the block remote from the cavity, the camming member having a pair of semi-cylindrical end portions disposed on opposite sides of the block and eccentric to the pivotal mounting on the block so that as the camming member is pivoted the distance from the one end of the block to the semi-cylindrical end portions of the camming member will change.

32. A tamper-proof cover for the operating nut of a hydrant, the cover comprising:

a disk-shaped housing adapted to be positioned above the operating nut for covering the operating nut, a tab extending from the housing and a circular hole in the tab;

a mounting securable to the hydrant and having means providing a cylindrical recess therein positionable in alignment with the opening in the housing;

the mounting having a passageway, the tab being engageable in the passageway, the mounting being covered by the housing when the housing and mounting are engaged; and locking means for securing the housing to the mounting, including a cylindrical pin positionable in the hole in the tab and matingly engageable with the cylindrical recess when the recess and hole are aligned, the locking means providing the recess having a frangible, shoulder within the recess spaced from but adjacent the pin, the pin having a groove and engaging the shoulder when the pin with the ring is inserted in the recess whereby the pin cannot be removed without the ring breaking the shoulder, the pin being slidably removable from the recess upon breaking the shoulder so that the housing can be removed to provide access to the operating nut.

33. A tool in combination with the tamper-proof cover defined in claim 32, the tool comprising:

a block having a cavity therein for receiving the end of the pin extending from the hole in the tab;

a pawl mounted in the block for pivotal movement into engagement with a groove in the end of the pin extending into the cavity when the block is inserted in the cavity;

a block having a cavity therein for receiving the end of the pin extending from the hole in the tab;

a pawl mounted in the block for pivotal movement into engagement with a groove in the end of the pin extending into the cavity when the block is inserted in the cavity;

means for removing the block from the extension while the pawl engages the pin so as to cause the frangible shoulder to break and release the pin for removal with the block.

34. A tool in combination with the tamper-proof cover defined in claim 33, wherein the means for removing the tool includes:

a camming member pivotally mounted to the block remote from the cavity, the camming member having a pair of semi-cylindrical end portions disposed on opposite sides of the block and eccentric to the pivotal mounting on the block so that as the camming member is pivoted the distance from the one end of the block to the semi-cylindrical end portions of the camming member will change.

35. A tool for unlocking locking means for removably securing a housing for covering an operating nut of a hydrant to mounting means for securing the housing to the hydrant, the locking means including a pin positionable in an opening in the housing and engageable with a recess defined in the mounting means, a locking member engageable with the pin and the recess in the mounting means, a frangible shoulder within the recess in the mounting means against which the locking member seats and which must be broken to slidably remove the pin from the recess so that the housing can be removed to provide access to the operating nut; the tool; comprising:

a block having a cavity in one end thereof;

a pawl mounted in the block for pivotal movement into and out of the cavity for engaging a circumferential groove in the pin inserted in the caviy and preventing removal of the pin from the cavity; and a camming member pivotally mounted to the block at another end thereof remote from the one end in which the cavity is formed, the camming member having a pair of semi-cylindrical end portions disposed on opposite sides of the block and eccentric to the pivotal mounting on the block so that as the camming member is pivoted the distance from the one end of the block to the semi-cylindrical end portions of the camming member will change.

36. A tool as defined in claim 35, including a handle secured to the camming member extending away from the block for providing leverage for pivoting the camming member relative to the block.

* * * * *

UNITED STATES PATENT AND TRADEMARK OFFICE

CERTIFICATE OF CORRECTION

PATENT NO. : 4,727,900

DATED : March 1, 1988

INVENTOR(S) : Joseph S. Dooling, Kenneth F. Vanek, Gene R. Vanek

It is certified that error appears in the above—identified patent and that said Letters Patent is hereby corrected as shown below:

Column 11, claim 18, line 8, "engageable the housing" should read "engageable with the housing". Column 12, claim 24, line 46, "thereof; and in a side portion thereof; and" should read "thereof; and". Column 13, claim 26, line 19, "recess and a hole" should read "recess and hole". Column 15, claim 35, lines 3 & 4, "the tool; comprising:" should read "the tool comprising:". Column 15, claim 35, line 8, "in the caviy" should read "in the cavity".

Signed and Sealed this

Thirteenth Day of December, 1988

*Attest:*

*Attesting Officer*

DONALD J. QUIGG

*Commissioner of Patents and Trademarks*